United States Patent [19]

Havel

[11] Patent Number: 4,702,615

[45] Date of Patent: Oct. 27, 1987

[54] ANALOG DISPLAY TIMEPIECE

[76] Inventor: Karel Havel, P.O. Box 66, Station M, Toronto, Ontario, Canada, M6S 4T2

[21] Appl. No.: 30,470

[22] Filed: Mar. 26, 1987

Related U.S. Application Data

[63] Continuation-in-part of Ser. No. 946,036, Dec. 24, 1986.

[51] Int. Cl.[4] ..... G04C 19/00; B04B 19/00

[52] U.S. Cl. ..... 368/82; 368/223; 368/239; 368/241; 340/701

[58] Field of Search ..... 368/10, 11, 82–84, 368/223, 228, 239–242; 340/701, 702

[56] References Cited

U.S. PATENT DOCUMENTS

| | | | |
|---|---|---|---|
| 3,922,847 | 12/1975 | Culley et al. | 58/50 |
| 3,937,004 | 2/1976 | Najori et al. | 368/11 |
| 4,044,546 | 8/1977 | Koike | 368/70 |
| 4,086,514 | 4/1978 | Havel | 315/500 |
| 4,451,157 | 5/1984 | Reap | 368/11 |

FOREIGN PATENT DOCUMENTS

| | | | |
|---|---|---|---|
| 2274966 | 1/1976 | France | 368/11 |
| 54-19788 | 2/1979 | Japan | 368/11 |

*Primary Examiner*—Vit W. Miska

[57] ABSTRACT

A timepiece includes a variable color display for providing an analog indication of time in a color in accordance with the relation of the indicated time to predetermined time limits.

9 Claims, 10 Drawing Figures

ANALOG DISPLAY TIMEPIECE

CROSS-REFERENCE TO RELATED APPLICATIONS

This is a continuation-in-part of my copending application Ser. No. 946,036, filed on Dec. 24, 1986, now pending entitled Variable Color Analog Voltmeter.

BACKGROUND OF THE INVENTION

1. Field of the Invention

This invention relates to timepieces utilizing variable color analog display.

2. Description of the Prior Art

An electronic timepiece disclosed in U.S. Pat. No. 3,922,847, issued on Dec. 2, 1975 to Bobby Gene Culley et al., includes a time base oscillator, counters, and a display consisting of 12 monochromatic light emitting diodes arranged in an inner ring, for individually indicating hours, and 60 monochromatic light emitting diodes arranged in an outer ring, for alternately indicating minutes and seconds.

Prior art monochromatic analog display timepieces are not capable of simultaneously indicating values of time and their relation to predetermined time limits.

SUMMARY OF THE INVENTION

Accordingly, it is the principal object of this invention to provide an improved analog display timepiece with a display capable of simultaneously indicating values of time and their relation to predetermined time limits.

In summary, electronic timepiece of the present invention includes a timekeeping device for measuring time and a variable color display for exhibiting an analog indication of time. Limit color control is provided for indicating time limits on the display in a selected color. The color of the analog indication of time is controlled in accordance with its relation to predetermined time limits.

Further objects of the invention will become apparent from the accompanying drawings and their description.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figure 1A:
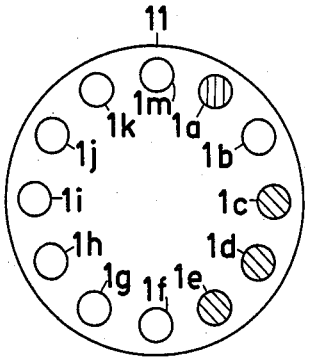
FIGS. 1*a* to 1*f* are examples of a timepiece display on which measured values of time and time limits are simultaneously indicated.

Referring now, more particularly, to the drawings, in FIGS. 1*a* to 1*f* is shown a variable color circular display 11, simulating the appearance of a timepiece face, on which are shown examples of different combinations of measured values of time and time limits. The display 11 includes twelve regularly spaced variable color display elements 1*a* to 1*m* which for the purpose of the description represent minutes in the 5 minutes steps. Thus display element 1*a* represents 5 minutes, display element 1*b* represents 10 minutes, display element 1*c* represents 15 minutes, etc., to present time in a substantially conventional manner. It would be obvious that, alternatively, the display elements may represent other time scales, such are 1 hour or 5 seconds steps.

By referring to several illustrated examples, display 11 in FIG. 1*a* simultaneously exhibits acceptable time field from low time limit 15 minutes to high time limit 25 minutes, by illuminating display elements 1*c*, 1*d*, and 1*e* in green color, and measured value of time 5 minutes (below the low time limit), by illuminating display element 1*a* in red color. The remaining display elements 1*b*, 1*f*, 1*g*, 1*h*, 1*i*, 1*j*, 1*k*, and 1*m* are extinguished. The red color of the measured value of time indicates that it does not lie within the bounds of the time limits.

Figure 1B:
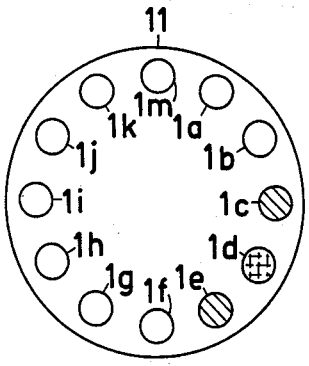

The display 11 in FIG. 1*b* exhibits the same time limits and measured value of time 20 minutes, by illuminating display element 1*d* in yellow color, to indicate that the measured value of time lies within the bounds of the time limits.

Figure 1C:
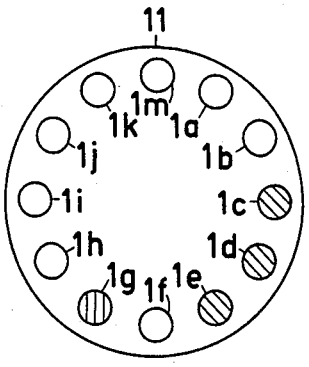

The display 11 in FIG. 1*c* exhibits the same time limits and measured value of time 35 minutes (above the high time limit), by illuminating display element 1*g* in red color, to indicate that the measured value of time does not lie within the bounds of the time limits.

Figure 1D:
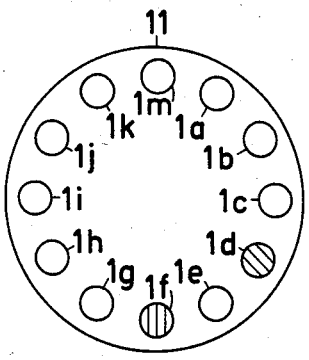

The display 11 in FIG. 1*d* exhibits a single time limit 20 minutes, by illuminating display element 1*d* in green color, and measured value of time 30 minutes, by illuminating display element 1*f* in red color, to indicate that the measured value of time is different from the time limit.

Figure 1E:
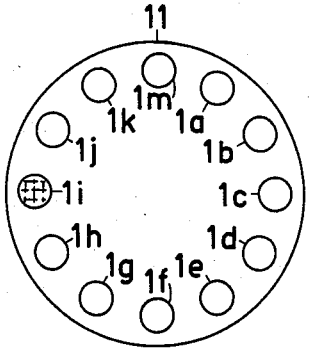

The display 11 in FIG. 1*e* exhibits a single time limit 45 minutes and measured value of time 45 minutes, by illuminating display element 1*i* in yellow color, to indicate that the measured value of time is equal to the time limit.

Figure 1F:
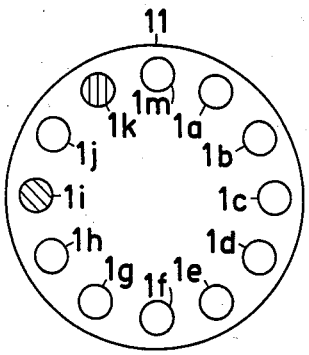

The display 11 in FIG. 1*f* exhibits the same single time limit 45 minutes, by illuminating display element 1*i* in green color, and measured value of time 55 minutes, by illuminating display element 1*k* in red color, to indicate that the measured value of time is different from the time limit.

Figure 2:
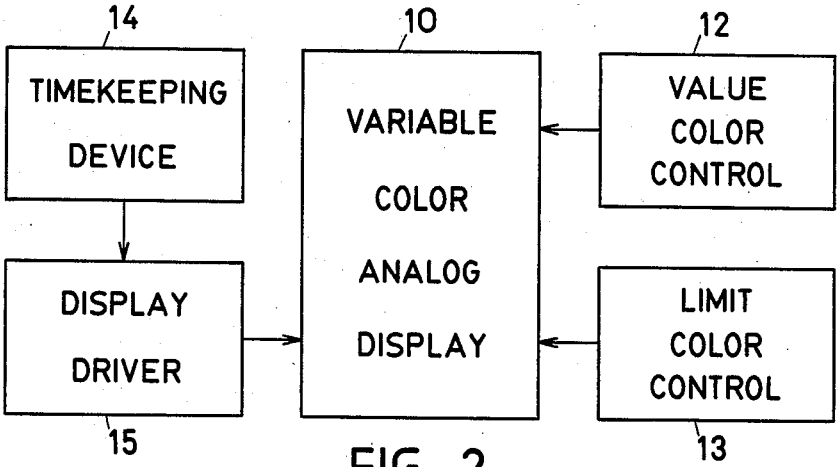
FIG. 2 is a block diagram of a variable color analog timepiece of the invention.

In FIG. 2 is shown a block diagram of a variable color analog timepiece of the invention which includes a timekeeping device 14 for measuring time and a display driver 15 for causing an analog indication of the measured value of time to be exhibited on a variable color analog display 10, in a manner well understood by those skilled in the art. The invention resides in the addition of a limit color control 13, for causing time limits to be exhibited on display 10 in a desired color, and a value color control 12, for controlling the color of the exhibited analog indication in accordance with its relation to the time limits. The analog timepiece of the invention is thus capable of simultaneously exhibiting measured value of time, by analog indication, and its relation to predetermined time limits, by color.

Figure 3:
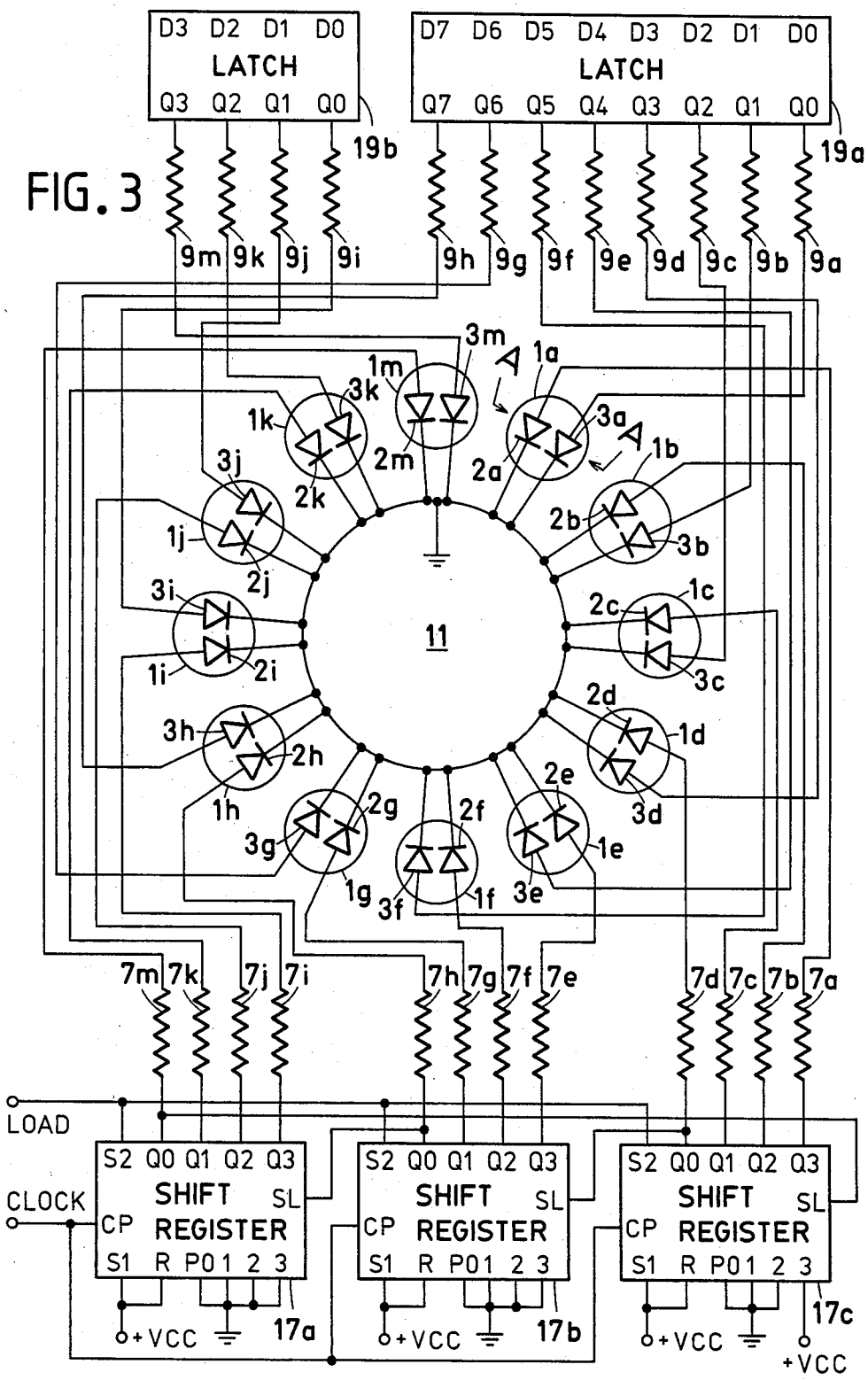
FIG. 3 is a schematic diagram of a variable color analog timepiece.

In FIG. 3 is shown a schematic diagram of a variable color analog timepiece. The circular display 11 includes twelve variable color display elements 1*a*, 1*b*, 1*c*, 1*d*, 1*e*, 1*f*, 1*g*, 1*h*, 1*i*, 1*j*, 1*k*, and 1*m*, regularly spaced along a circle to resemble a conventional timepiece face, which may be progressively energized to exhibit analog indication of time.

Each display element 1 includes a pair of closely adjacent LEDs (light emitting diodes): red LED 2 and green LED 3 which are adapted for producing a composite light signal of a variable color. The anodes of all red LEDs 2a, 2b, 2c, 2d, 2e, 2f, 2g, 2h, 2i, 2j, 2k, and 2m are respectively coupled to the outputs Q0, Q1, Q2, and Q3 of commercially well known shift registers 79a, 79b, and 79c. The anodes of all green LEDs 3a, 3b, 3c, 3d, 3e, 3f, 3g, 3h, 3i, 3j, 3k and 3m are respectively coupled, via current limiting resistors 9a, 9b, 9c, 9d, 9e, 9f, 9g, and 9h, to the outputs Q0, Q1, Q2, Q3, Q4, Q5, Q6, and Q7 of 8-bit latch 19a and, via current limiting resistors 9i, 9j, 9k, and 9m to the outputs Q0, Q1, Q2, and Q3 of 4-bit latch 19b. The cathodes of all red LEDs 2a to 2m and all green LEDs 3a to 3m are commonly grounded. Data representing predetermined low and high time limits, defining the acceptable time field, may be stored in latches 19a and 19b by presenting the data to their inputs D0 to D7 and by activating their latching inputs (not shown).

The display 11 is controlled by chain of shift registers 17a, 17b, and 17c adapted for shifting data to the left by having their Shift Left inputs SL respectively coupled to outputs of the next one of the shift registers and by having their select inputs S1 coupled to a high logic level, in a manner well understood by those skilled in the art. The parallel inputs P0, P1, P2, and P3 of all shift registers are coupled to a low logic level, except for the most significant input P3 of shift register 17c which is coupled to a high logic level. When a short positive pulse LOAD is applied to interconnected select inputs S2, the data from the parallel inputs are loaded into the shift registers, appear at their outputs Q0, Q1, Q2, and Q3, and may be progressively shifted to the left with each active clock transition when the inputs S2 are returned to a low logic level. A high logic level at a particular output Q of the shift registers forwardly biases red LED in the associated display element.

The operation of the timepiece will be explained on several examples. EXAMPLE 1a considers low time limit 15 minutes and high time limit 25 minutes. Data representing such limits may be stored in latches 19a and 19b by applying a high logic level to inputs D2, D3, and D4 of latch 19a, by applying a low logic level to all remaining inputs D0, D1, D5, D6, and D7 of latch 19a and D0, D1 D2, and D3 of latch 19b, and by activating latching inputs (not shown). As a result, outputs Q2, Q3, and Q4 of latch 19a rise to a high logic level. The current flows from the output Q2 of latch 19a via current limiting resistor 9c and green LED 3c to ground. The current also flows from the output Q3 of latch 19a via resistor 9d and green LED 3d to ground. The current also flows from the output Q4 of latch 19a via resistor 9e and green LED 3e to ground. As a consequence, green LEDs 3c, 3d, and 3e illuminate. The remaining green LEDs are extinguished because the remaining outputs of latches 19a and 19b are at a low logic level. When the output Q3 of shift register 17c rises to a high logic level, which corresponds to value of time 5 minutes, the current flows therefrom via current limiting resistor 7a and red LED 2a to ground. As a result, red LED 2a illuminates. The overall effect is that display elements 1c, 1d, and 1e illuminate in green color, to indicate acceptable time field from 15 minutes to 25 minutes, and display element 1a illuminates in red color, to simultaneously indicate the measured value of time (about 5 minutes), by position, and its relation to the limits, by red color (meaning that it does not lie within the bounds of the time limits), as viewed in FIG. 1a.

EXAMPLE 1b considers the same time limits and measured value of time 20 minutes. At such time, the output Q0 of shift register 17c rises to a high logic level. The current flows from the output Q0 of shift register 17c via resistor 7d and red LED 2d to ground, causing red LED 2d to illuminate. As a result of internal blending of light signals emitted by green LED 3d and red LED 2d, the display element 1d illuminates in substantially yellow color. The overall effect is that display elements 1c and 1e illuminate in green color, to indicate the low time limit 15 minutes and high time limit 25 minutes, and display element 1d illuminates in yellow color, to indicate that the measured value of time (about 20 minutes) lies within the bounds of the time limits, as viewed in FIG. 1b.

EXAMPLE 1c considers the same time limits and measured value of time 35 minutes. At such time, the output Q1 of shift register 17b rises to a high logic level. The current flows from the output Q1 of shift register 17b via resistor 7g and red LED 2g to ground, causing red LED 2g to illuminate. The overall effect is that display elements 1c, 1d, and 1e illuminate in green color, to indicate acceptable time field from 15 minutes to 25 minutes, and display element 1g illuminates in red color, to indicate that the measured value of time (about 35 minutes) does not lie within the bounds of the time limits, as viewed in FIG. 1c.

EXAMPLE 1d considers a single time limit 20 minutes. Data representing such time limit stored in latches 19a and 19b cause the output Q3 of latch 19a to rise to a high logic level and all remaining outputs of latches 19a and 19b to drop to a low logic level. The current flows from the output Q3 of latch 19a via resistor 9d and green LED 3d to ground, causing green LED 3d to illuminate. Considering the measured value of time to be 30 minutes, the output Q2 of shift register 17b at such time rises to a high logic level. The current flows therefrom via resistor 7f and red LED 2f to ground, causing red LED 2f to illuminate. The overall effect is that display element 1d illuminates in green color, to indicate time limit 20 minutes, and display element 1f illuminates in red color, to indicate that the measured value of time (about 30 minutes) is not equal to the time limit, as viewed in FIG. 1d.

EXAMPLE 1e considers a single time limit 45 minutes. Data representing such limit stored in latches 19a and 19b cause the output Q0 of latch 19b to rise to a high logic level and all remaining outputs of latches 19a and 19b to drop to a low logic level. The current flows from the output Q0 of latch 19b via resistor 9i and green LED 3i to ground, causing green LED 3i to illuminate. Considering the measured value of time to be 45 minutes, the output Q3 of shift register 17a at such time rises to a high logic level. The current flows therefrom via resistor 7i and red LED 2i to ground, causing red LED 2f to illuminate. As a result of internal blending of light signals emitted by green LED 3i and red LED 2i, display element 1i illuminates in substantially yellow color to indicate that the measured value of time (about 45 minutes) is equal to the time limit, as viewed in FIG. 1e.

EXAMPLE 1f considers the same time limit 45 minutes and measured value of time 55 minutes. At such time, the output Q1 of shift register 17a rises to a high logic level. The current flows therefrom via resistor 7k and red LED 2k to ground, causing red LED 2k to illuminate. The overall effect is that display element 1*i* illuminates in green color, to indicate time limit 45 minutes, and display element 1*k* illuminates in red color, to indicate that the measured value of time (about 55 minutes) is not equal to the time limit, as viewed in FIG. 1*f*.

Figure 4:
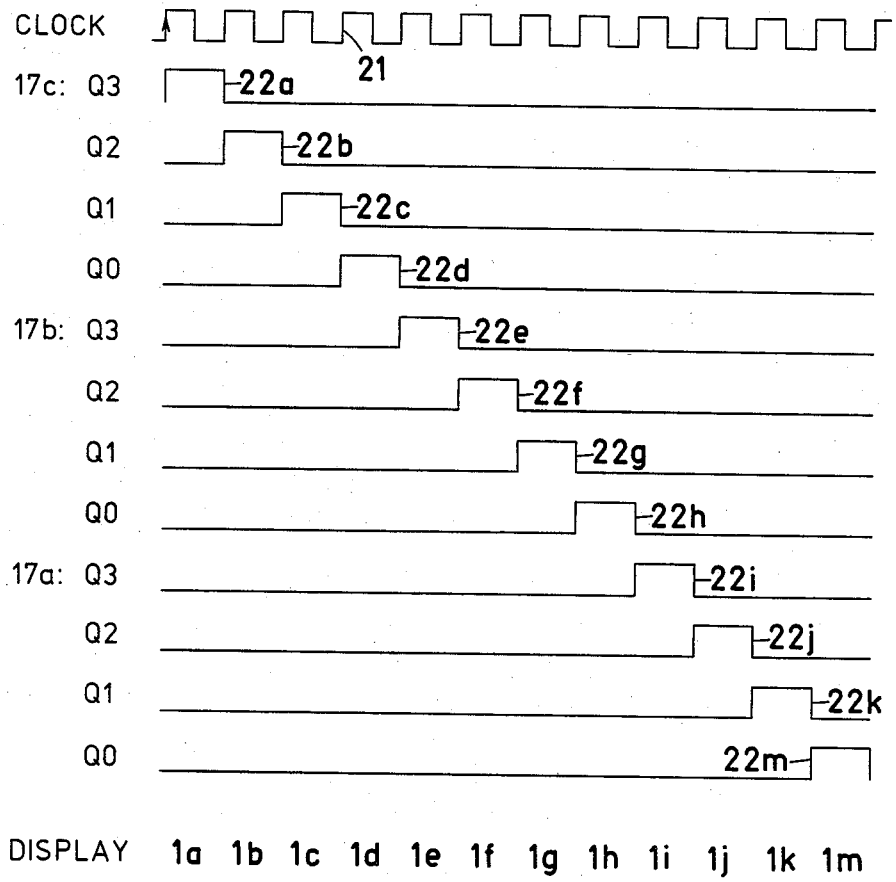
FIG. 4 is a timing diagram showing the timing relationship of output signals in shift register chain in FIG. 3.

In FIG. 4 is shown a timing diagram of the output signals in the shift register chain in FIG. 3. Clock pulses 21 are applied to interconnected Clock Pulse inputs CP of shift registers 17*a*, 17*b*, and 17*c* to serially deliver their contents to the left with each low-to-high clock transition. Initially, the output Q3 of shift register 17*c* is at a high level, as shown by pulse 22*a*, for causing the associated display element 1*a* to illuminate, while all other outputs of shift registers 17*a*, 17*b*, and 17*c* are low, for causing the remaining display elements to extinguish. When the high logic level is shifted to the output Q2 of the same shift register, as shown by pulse 22*b*, display element 1*b* illuminates. When the high logic level is shifted to the output Q1 of the same shift register, as shown by pulse 22*c*, display element 1*c* illuminates, etc., for indicating time in substantially conventional manner.

It is readily apparent that the rate of movement of the analog indication on display 11 depends on the period of the clock pulses 21. When the clock period is 1 hour, the display indicates one of 12 hours. When the clock period is 5 minutes, the display indicates time to the nearest 5 minutes. When the clock period is 5 seconds, the display similarly indicates time to the nearest 5 seconds. It would be obvious to add additional display elements and shift registers to provide more accurate indication of time.

Figure 5:
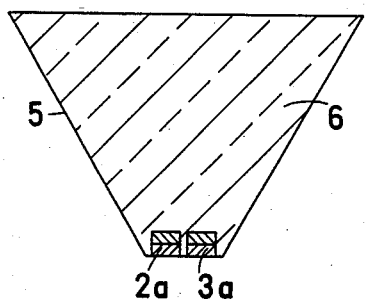
FIG. 5 is an enlarged cross-sectional view of one display element in FIG. 3, taken along the line A—A.

In FIG. 5, red LED 2*a* and green LED 3*a* are placed on the base of a segment body 5 which is filled with a transparent light scattering material 6. When forwardly biased, the LEDs 2*a* and 3*a* emit light signals of red and green colors, respectively, which are scattered within the transparent material 6, thereby blending the red and green light signals into a composite light signal that emerges at the upper surface of segment body 5. The color of the composite light signal may be controlled by varying the portions of red and green light signals.

Although not shown in the drawings, it will be appreciated that the timepiece of this invention may have any conceivable form or shape, such as a wrist watch, pocket watch, clock, alarm clock, and the like. Alternatively, the timepiece may have characteristics of an article for wearing on a body of wearer or for securing to wearer's clothing, such as a bracelet, ring, ear-ring, necklace, tie tack, button, cuff link, brooch, hair ornament, and the like, or it may be built into, or associated with, an object such as a pen, pencil, ruler, lighter, briefcase, purse, and the like.

The invention may be now briefly summarized. The method was disclosed of simultaneously indicating a measured value of time and its relation to a predetermined time limit, on a single variable color analog display, by causing an analog indication of time to be exhibited on the display and by controlling the color of the indication in accordance with the relation of the measured value of time to the time limit.

A variable color analog timepiece was disclosed that comprises a timekeeping device for measuring time, variable color analog display for providing an analog indication of the value of time, and color control for controlling the color of the analog indication in accordance with the relation of the measured value of time to a low and high predetermined time limits. The field between the time limits may be also exhibited on the display in a different color than the analog indication.

All matter herein described and illustrated in the accompanying drawings should be interpreted as illustrative and not in a limiting sense. It would be obvious that numerous modifications can be made in the construction of the preferred embodiment shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 1 | display element | |
| 2 | red LED | |
| 3 | green LED | |
| 5 | segment body | |
| 6 | light scattering material | |
| 7 | resistor | |
| 9 | resistor | |
| 10 | variable color analog display | |
| 11 | variable color circular display | |
| 12 | timekeeping device | |
| 13 | display driver | |
| 14 | value color control | |
| 15 | limit color control | |
| 17 | 4-bit shift register | 74LS194 |
| 19 | 8-bit latch | 74F373 |
| 21 | clock pulses | |
| 22 | pulse | |

What I claim is:

1. A method of simultaneously indicating a measured value of time and its relation to a predetermined time limit, on a single variable color analog display means, by causing an analog indication of time to be exhibited on said display means and by controlling the color of said indication in accordance with the relation of said value of time to said time limit.

2. A timepiece comprising:

timekeeping means;

variable color analog display means for providing an analog indication of a value of time; and color control means for controlling the color of said analog indication in accordance with the relation of said value of time to a predetermined time limit.

3. A method of simultaneously indicating a measured value of time, a predetermined time limit, and the relation of said value of time to said time limit, on a single variable color analog display means, by causing said time limit to be exhibited on said display means in a first color and by causing an analog indication of the value of time to be exhibited on said display means either in a second or in a third color in accordance with the relation of said value of time to said time limit, said first, second and third colors being respectively different.

4. A timepiece comprising:

timekeeping means;

variable color analog display means for providing an analog indication of a value of time;

means for exhibiting a predetermined time limit on said display means in a first color; and color control means for illuminating said analog indication either in a second or in a third color in accordance with the relation of said value of time to said time limit, said first, second and third colors being respectively different.

5. A timepiece comprising:

timekeeping means;

variable color analog display means for providing an analog indication of a value of time;

means for exhibiting predetermined low and high time limits, defining an acceptable time field, on said display means in a first color; and color control means for illuminating said analog indication either in a second color when said value of time does not lie within the bounds of said low and high time limits or in a third color when said value of time lies within the bounds of said low and high time limits, said first, second, and third colors being respectively different.

6. A timepiece as defined in claim 5 wherein said third color is obtained by blending said first and second colors.

7. A timepiece comprising:

timekeeping means;

variable color analog display means for providing an analog indication of a value of time;

memory means for storing data representing values of time limits;

limit control means responsive to said memory means for selectively exhibiting time limits on said display means in a first color; and color control means for illuminating said analog indication either in a second or in a third color in accordance with the relation of said value of time to said time limits, said first, second, and third colors being respectively different.

8. A timepiece according to claim 7 wherein said memory means stores data representing a field between predetermined low and high time limits; and said limit control means exhibits on said display means said field in said first color.

9. A timepiece comprising:

timekeeping means;

analog display means including a plurality of variable color display elements regularly arranged along a circle, each said display element including a first light source for emitting upon activation light signals of a first primary color, second light source for emitting upon activation light signals of a second primary color, and means for combining said signals in each said display element to obtain a composite light signal of a composite color;

memory means for storing data representing values of predetermined low and high time limits;

limit control means responsive to said memory means for selectively activating certain of said first light sources corresponding by positions in said circle to a field between said low and high time limits, for illuminating said field in said first primary color;

value control means for providing on said display means an analog indication of a value of time by selectively activating a single one of said second light sources corresponding by a position in said circle to the value of time, for iluminating it in said second primary color;

whereby said analog indication is illuminated either in said second primary color when said value of time does not lie within the bounds of said high and low limits or in said composite color when said value of time lies within the bounds of said high and low time limits.

* * * * *